US010538123B1

(12) United States Patent
Kirk et al.

(10) Patent No.: US 10,538,123 B1
(45) Date of Patent: Jan. 21, 2020

(54) FOLDER POCKET DIVIDER AND METHOD OF CONSTRUCTION

(71) Applicant: Smead Manufacturing Company, Hastings, MN (US)

(72) Inventors: Jeffrey Kirk, St. Paul, MN (US); GinAnn Matsch, Hastings, MN (US); Scott Wiegrefe, Apple Valley, MN (US)

(73) Assignee: Smead Manufacturing Company, Hastings, MN (US)

( * ) Notice: Subject to any disclaimer, the term of this patent is extended or adjusted under 35 U.S.C. 154(b) by 0 days.

(21) Appl. No.: 16/116,241

(22) Filed: Aug. 29, 2018

Related U.S. Application Data

(63) Continuation of application No. 15/187,981, filed on Jun. 21, 2016, now Pat. No. 10,065,444.

(60) Provisional application No. 62/182,981, filed on Jun. 22, 2015.

(51) Int. Cl.
*B42F 7/06* (2006.01)
*B42F 7/08* (2006.01)
*B31D 5/00* (2017.01)

(52) U.S. Cl.
CPC ..... *B42F 7/06* (2013.01); *B31D 5/0004* (2013.01); *B42F 7/08* (2013.01)

(58) Field of Classification Search
CPC ..... B42F 7/06; B42F 7/08; B42F 13/0053; B31D 5/0004; B31D 5/0017
See application file for complete search history.

(56) References Cited

U.S. PATENT DOCUMENTS

| | | | | |
|---|---|---|---|---|
| 154,546 | A * | 9/1874 | Foye | B42F 9/001 281/45 |
| 1,551,302 | A * | 8/1925 | Gabel | B42F 5/005 206/311 |
| 5,720,427 | A | 2/1998 | Kachel et al. | |
| 6,273,470 | B1 | 8/2001 | Bullock | |
| 6,837,368 | B1 * | 1/2005 | Chang | G11B 33/0444 206/232 |
| 8,540,138 | B1 | 9/2013 | Christensen et al. | |
| 8,550,330 | B2 | 10/2013 | Black et al. | |
| 8,746,539 | B2 | 6/2014 | Dodson | |
| 2007/0125835 | A1 * | 6/2007 | Pelleg | B42F 7/08 229/67.3 |
| 2014/0131427 | A1 | 5/2014 | Scott et al. | |

* cited by examiner

*Primary Examiner* — Derek J Battisti

(74) *Attorney, Agent, or Firm* — Hamre, Schumann, Mueller & Larson, P.C.

(57) ABSTRACT

Installable and removable inserts for pocket folders and their method of manufacturer are shown and described. Inserts have spaced part divider panels which are anchored to a base plate or form a base plate. In one embodiment, a single plate divider also forms the base and one upright divider while another element with two dividers is bonded to the base. In another embodiment two separate upright dividers are bonded together at a common upright wall and the pair is then bonded to a base. Other embodiments are disclosed.

6 Claims, 15 Drawing Sheets

FOLDER POCKET DIVIDER AND METHOD OF CONSTRUCTION

CROSS-REFERENCE TO RELATED APPLICATION

This application claims priority and incorporates by reference in their entirely the disclosure of U.S. provisional patent application No. 62/182,981 filed 22 Jun. 2015.

BACKGROUND

Field of the Disclosure

The present invention is directed to dividers for folders in connection with storage of documents.

Incorporation by reference: This application hereby incorporates the following patent disclosures by reference in their entirety: U.S. Pat. No. 5,720,427 to Kachel et al., Reinforced Expanding Folders; U.S. Pat. No. 6,273,470 to Bullock, Slip Resistant File Folders; U.S. Pat. No. 8,746,539 to Dodson, Visually Enhanced Tab File System; U.S. Pat. No. 8,550,330 to Black et al., Integrated Tab Hanging File System.

Background

Folders and more particularly pocket folders are useful for holding documents permanently or temporarily. Many pocket folders have accordion side walls to make them expandable to accommodate more papers. It would be desirable to be able to subdivide the pocket folder to segregate papers. A common solution is to simply insert separate folders within the pocket, but they tend to slide down into the pocket, and if they have visual indicator tabs, the tabs are no longer visible. To build dividers into the pocket folder at time of manufacture limits the flexibility of the pocket in case a large block of papers would fill the entire space, and the dividers would get into the way.

Thus, there has been a long felt need to solve both problems: 1) provide flexibility of a pocket folder to have a large opening; 2) to provide a divider system which could be removably installed into a pocket folder when needed; and 3) tabs on the dividers would not slide down into the pocket and thus would no longer be visible to the user. The technology to solve this problem has long existed, but no comprehensive solution has been heretofore found. The present invention solves the above mentioned problems, amongst others.

BRIEF SUMMARY

To assist the reader in preparing to digest the detailed description and claims below, a short summary has been provided. It is not intended to be a complete disclosure but rather provides a glimpse of the invention concepts. It is not intended to define the scope of the invention. The claims perform that function. There are several embodiments in this disclosure.

There is disclosed a divider unit for use in a pocket container having spaced apart sidewalls a width for receiving documents, having any or all of the following elements; a unitary web of generally planar material having a plurality of fold lines to form a plurality of divider panels and a foot having flanges. In the preferred embodiment, the web material is a fiber paper board material which can be folded and will retain its folded state along a fold line. The foot is sized to be inserted within a container in said width to provide subdividing panels to separate groups of documents. The foot should be narrower than the space/width provided for in the pocket container though accordion pockets have variable width so different foot widths are possible.

The web material is folded to include or create the following structures: a pair of spaced apart upwardly oriented divider panels having top and bottom ends. Note that "upward" orientation is intended to help the reader when the insert is oriented in a pocket container with an open top. If it has a side opening, then "upwardly" means toward the opening in the pocket container. The bottom ends of each divider panel having an outward extending first portions, or flanges formed by folding of portions of the panel. The first portions further having a further second portion being folded under said first portion wherein the second folded under portion from each divider panel connecting together, thereby forming together a foot portion under the first portions and between said spaced apart panels, as one continuous web.

Also disclosed is a divider unit for use in a pocket container having spaced apart sidewalls a width for receiving documents, having any or all of the following elements: a unitary web of generally planar material having a right and left end and at least first, second, third and fourth score and/or fold lines to define a plurality of regions. The right and left sides being interchangeable terms and provide only reference. The term score line and fold line should be interpreted to be interchangeable. Where there is a fold line there may also be a score line:

a. a first region between the right end and second first score line, thereby defining a right divider panel;

b. a second region between the first and second score lines, thereby defining a second portion. This portion may be a relatively narrow strip equal to the spaced desired between an inner wall of the pocket and this first most adjacent upright divider panel.

c. a third region between the second and third score lines, thereby defining a third portion foot plate. The foot plate is typically a width equal to or narrower than the width of the inner walls of the container. In an accordion container, this may be variable.

d. a fourth region between the third and fourth score lines, thereby defining a fourth portion. This region can be a mirror image of the second region if the divider spacing is symmetrical or equidistant.

e. a fifth region between the fourth score line and the left end, thereby defining the left divider panel. The region is typically the other divider panel.

wherein said first region is generally perpendicular to said second region. Perpendicular is meant to be generally at right angles but since the web material is flexible it is at least upright;

wherein said second and third regions are folded in at least partial overlapping abutment with each other. The second and third regions are thus folded on each other. The second region is typically narrower so that they may only partially overlap;

wherein said third and fourth regions are folded in at least partial overlapping abutment with each other. The same conditions apply as for second and third regions.

wherein said left panel is generally perpendicular to said third and fourth regions and wherein said right panel is generally perpendicular to said first and second regions; thereby creating a pair of spaced apart left and right panels and a foot plate insertable into said pocket container formed as one continuous web. A continuous web means that the material need not be bonded together to form this shape, though that is also possible within the scope of this disclosure.

There is also disclosed a method of forming a unitary web material into a divider system for a pocket folder comprising any or all of the steps of, in any order:

a. cutting a blank of web material defining right and left edges and a center dividing line therebetween thereby defining left and right divider panels;
b. scoring first fold lines in said web material spaced from and parallel with said center dividing line on both left and right divider panels;
c. scoring second fold lines in said web material spaced from and parallel with said second score line, on both left and right divider panels and thereby defining a portion between said first and second score line and defining a foot region between first fold lines on right and left panels. This will create the regions as mentioned above.
d. folding said web material on said first and second score lines to fold said portion onto foot region and bonding said portion to said region on both left and right panels;
e. folding said second score line to permit said left and right panels to be generally oriented orthogonally to said foot portion.

There is also disclosed a divider unit for use in a pocket container having spaced part sidewalls defining a width for receiving documents, having a first unitary web of generally planar material having a plurality of score and fold lines folded to form a pair of first and second generally upright panels with a central bottom portion between and joining said upright panels and generally orthogonal thereto. The word "upright" has been defined earlier and necessarily in an up oriented position, but toward the opening of a container box. The unitary web is preferably a single piece of material, often a paper or fiber but may also be other materials. The score lines are indentations pressed into the web to define the location of a fold.

A second unitary web of generally planar material having a plurality of score and fold lines folded to form a pair of third and fourth generally upright panels with a central bottom portion between and joining said upright panels and generally orthogonal thereto a foot plate having a width not greater than said defined pocket width. The pocket width is the space between inner walls of the pocket container, wherein said second and third panels are bonded together to form a common double walled panel and together forming a three generally upright dividers and wherein the bottoms of the unitary webs are bonded to said foot plate, so that said foot plate forms a bottom of the divider unit and is sized to be received within said pocket container.

There is also disclosed a method of forming a divider system for a pocket folder having any or all of the following steps, in any order:

a. cutting a first blank of web material defining right and left edges and a center dividing line therebetween thereby defining left and right divider panels. The center line is an imaginary line to define left and right sides for purposes of understanding the method.
b. scoring said first blank at a first fold line in the right side of said web material spaced from and parallel with said center dividing line. This defines one edge of a bottom region.
c. scoring said first blank at a second fold line in the right side of said web material spaced from and parallel with said center dividing line. This defines the extent of the bottom region, i.e. between the fold lines.
d. folding said web material on said first and second score lines to create a bottom region and first and second generally upright panels.
e. cutting a second blank of web material defining right and left edges and a center dividing line therebetween thereby defining left and right divider panels. The second blank is folded in a manner similar to the first blank. There can be 3, 4 or a plurality of blanks similarly formed.
f. scoring said second blank at a third fold line in the right side of said web material spaced from and parallel with said center dividing line;
g. scoring said second blank a fourth fold line in the right side of said web material spaced from and parallel with said center dividing line;
h. folding said web material on said third and fourth score lines to create a bottom region and third and fourth generally upright panels;
i. bonding said second and third panels together so that their bottoms are generally planar with each other. Bonding can be by adhesive or other chemical or mechanical way to join the panels.
j. cutting a third blank of material into a foot plate;
k. bonding said bottoms to said foot plate;
so that a divider is created with three generally upright divider panels, one of which being double thickness and a foot plate sized to be received within a pocket container.

There is also disclosed a divider unit for use in a pocket container having spaced part sidewalls defining a width for receiving documents, having any or all of the following elements: a first unitary web of generally planar material having a plurality of score or fold lines folded to form a pair of first and second generally upright panels with a central bottom portion between and joining said upright panels and generally orthogonal thereto; a second unitary web of generally planar material having an upper and lower end, and at least first and second score lines to define three regions, a first region formed between said first score line and toward said upper end to create a third generally upright panel; a second region formed between said first and second score lines to create an intermediate portion; a third region formed between the second score line and toward said lower end to create a foot plate having a distal end; wherein a portion on said third region is folded into overlapping abutment with said second region and bonded thereto; wherein said central bottom portion is bonded to a portion of said foot plate spaced from said third upright panel thereby creating first, second and third generally upright panels extending from said footplate, and thereby defining spaces between said panels for document retention. In this embodiment it is possible to have at least three divider panels in the divider with only two separate web components. One web is used to create at least two divider panels and the other web provides a single panel and the bottom foot.

There is further disclosed a divider further including a third and fourth score line in said foot plate, said third score line being adjacent and parallel to said second score line and said fourth score line being adjacent to but spaced from the end of the distal end of the foot plate; said third and fourth score lines and wherein space on the web between said second and third score lines defining a first foldable adjustment portion and wherein the space on the web between said fourth fold line and the distal end of the foot plate defines a second foldable adjustment portion, and wherein said adjustable portions are foldable according to user desire to adapt the divider insert to varying foot plate dimensions. This feature, which is applicable to all embodiments, provides a second score line which is available to the user to define a foot width of varying size. The score lines can be folded to fold over a region/portion to narrow the foot base. Multiple score lines can be made in the foot plate so that the plate can be sized to virtually any container width by folding over or folding up part of the plate to make it narrower.

There is also disclosed a method of forming a divider system for a pocket folder comprising any or all of the following steps, in any order:

a. cutting a first blank of web material defining right and left edges and a center dividing line therebetween thereby defining left and right divider panels;
b. scoring said first blank at a first fold line in the right side of said web material spaced from and parallel with said center dividing line;
c. scoring said first blank at a second fold line in the right side of said web material spaced from and parallel with said center dividing line;
d. folding said web material on said first and second score lines to create a bottom region and first and second generally upright panels;
e. cutting a second blank of web material defining upper and lower edges;
f. creating two parallel score lines in said second blank between upper and lower edges to define three regions:
   a first region formed between said first score line and toward said upper end to create a third generally upright panel;
   a second region formed between said first and second score lines to create an intermediate portion;
   a third region formed between the second score line and toward said lower end to create a foot plate;
g. folding said third region into overlapping abutment with said second region and bonding it thereto;
h. bonding the said central bottom portion pf said first blank to a portion of said foot plate at a location on said foot plate spaced from said third upright panel;
   thereby creating first, second and third generally upright panels extending from said footplate, and thereby defining spaces between said panels for document retention.

DETAILED DESCRIPTION

Figure 1:
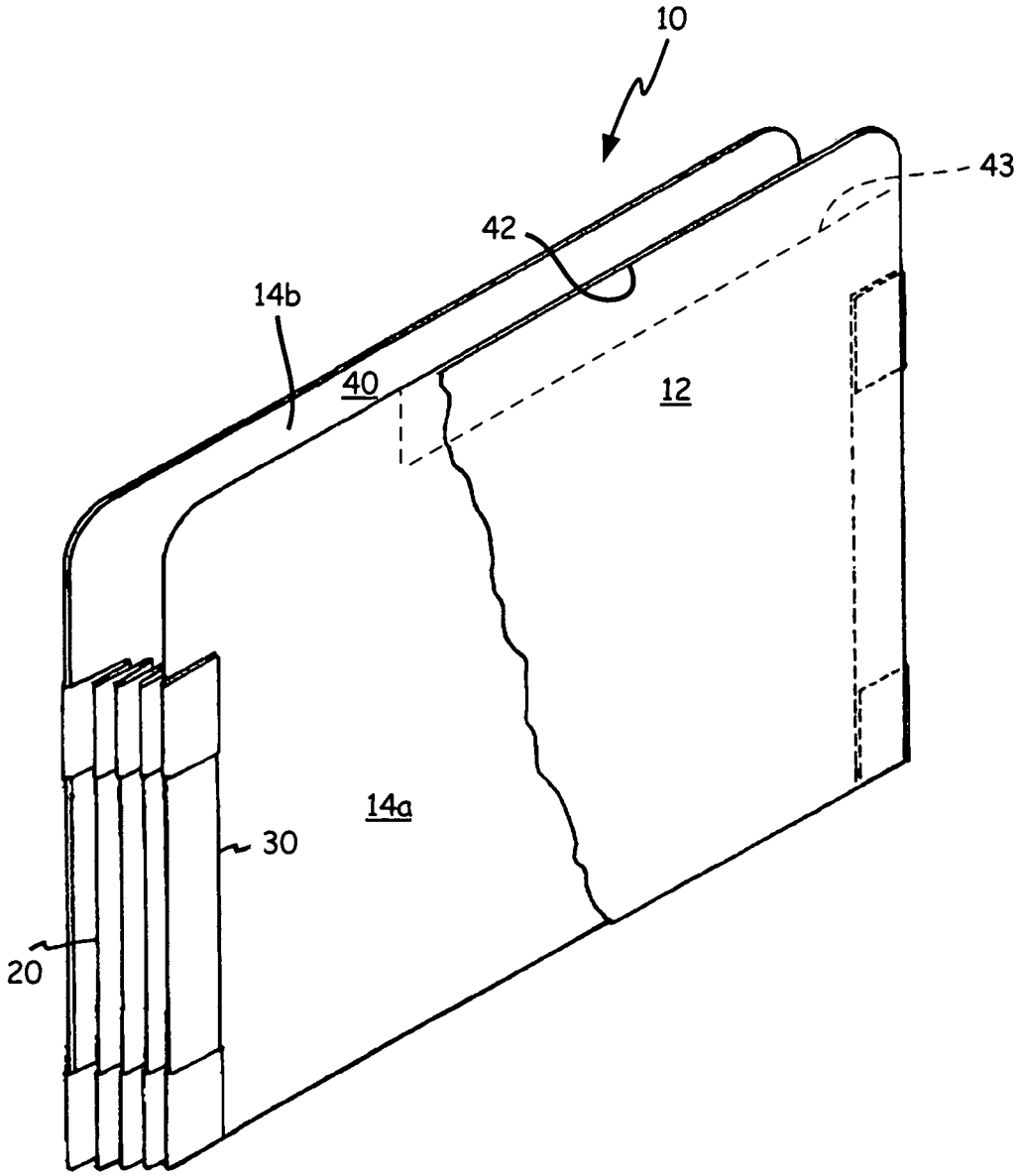
FIG. 1 (PRIOR ART)
FIG. 1 is a perspective view of a pocket folder.

This disclosure describes file folder, sometimes known as a pocket, and a removable divider system, and method of manufacturer and assembly. The removable divider system may be used with containers other than a file or pocket, such as a box or filing cabinet. For simplicity we will refer to all containers as a pocket. The divider may be removable or affixed permanently.

A method of manufacturer is also disclosed by the drawings and description.

Pocket 10 in FIGS. 1-6 show a unitary blank with a front extension panel 12, first panel 14*a* and second panel 14*b*. The extension panel 12 extending laterally from the second panel 14*a* along fold lines 20 which are formed of a plurality of zig zag/accordion fold lines which provide for expansion. It is also possible to construct this pocket without the accordion folds and be merely flat, without expansion capability. Extension panel 12 extends from panel 14*a/b* along fold lines 20, panel 12 which becomes the front panel when folded, includes a pair of flaps 30, 32 which complete the folder when the flaps are adhered to the back panel. Hap 30 is an extension of the front panel along the longitudinal edge and 32 is an extension along the lateral edge along fold lines 34, 26.

In order to insure that there will be tab/writing space 40, visible at the top (distal) edge of each panel, it is preferably to offset/cut away a portion of panel 12 at its top tab edge 42. This offset 43 (shown in broken lines as an option) provides exposure of the tab section 40 of panel 14*a* by being shorter than panel 14*b*.

Figure 4:
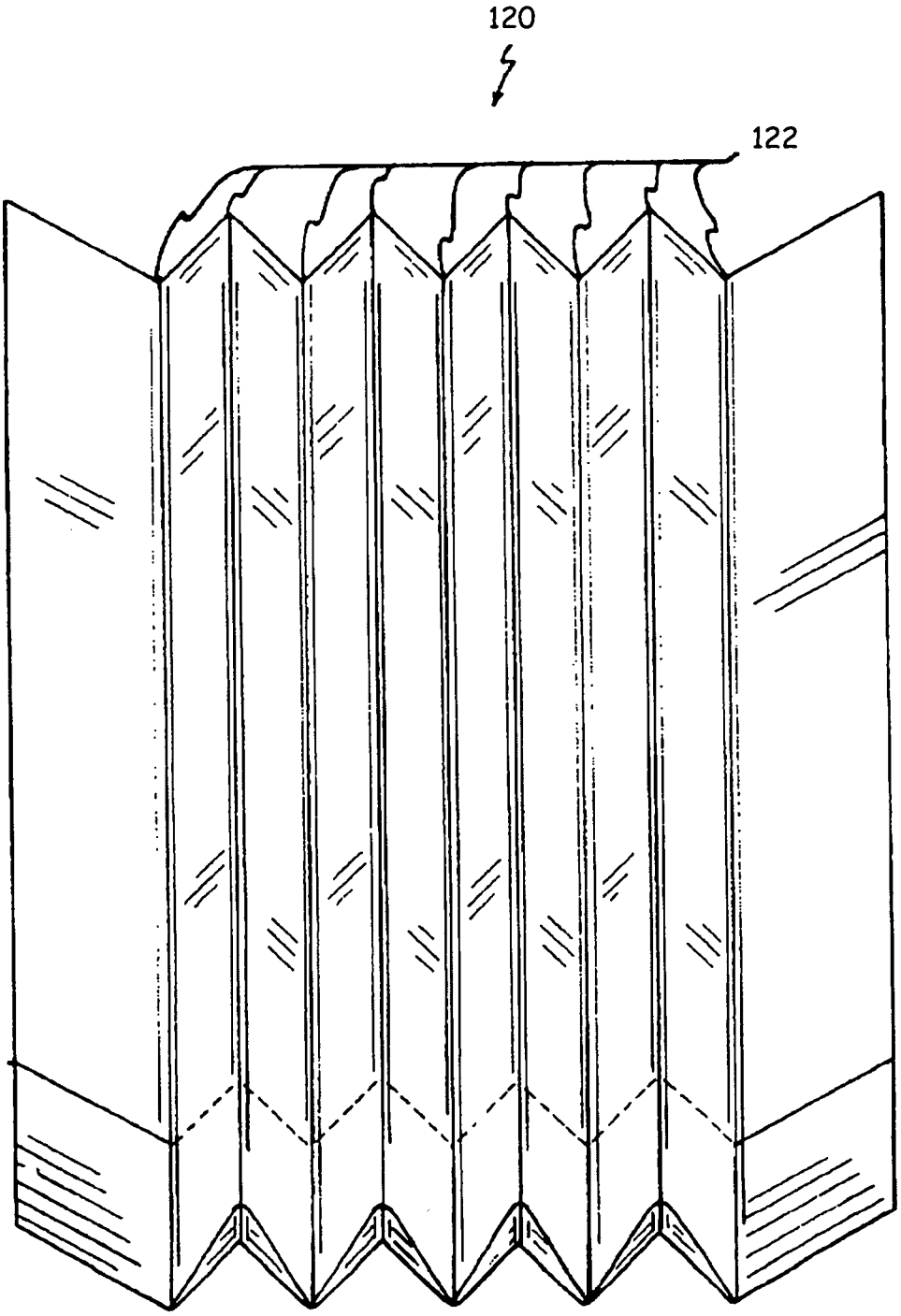
FIG. 4 is a perspective view of left and right gussets for the pocket folder.

In FIG. 4, the left and right sidewalls 120 (identical) can be seen. These sidewalls are affixed to the folded portions 30/32 of the panels 14*a/b*. The gusset 120 comprises a material which is repeatedly folded on top of itself in a well-known manner. The folded gusset 120 has an accordion-like expansion capability of zig zag folds 120 which permits the pocket 10 to gradually expand as it is filled with items to be stored.

Figure 2:
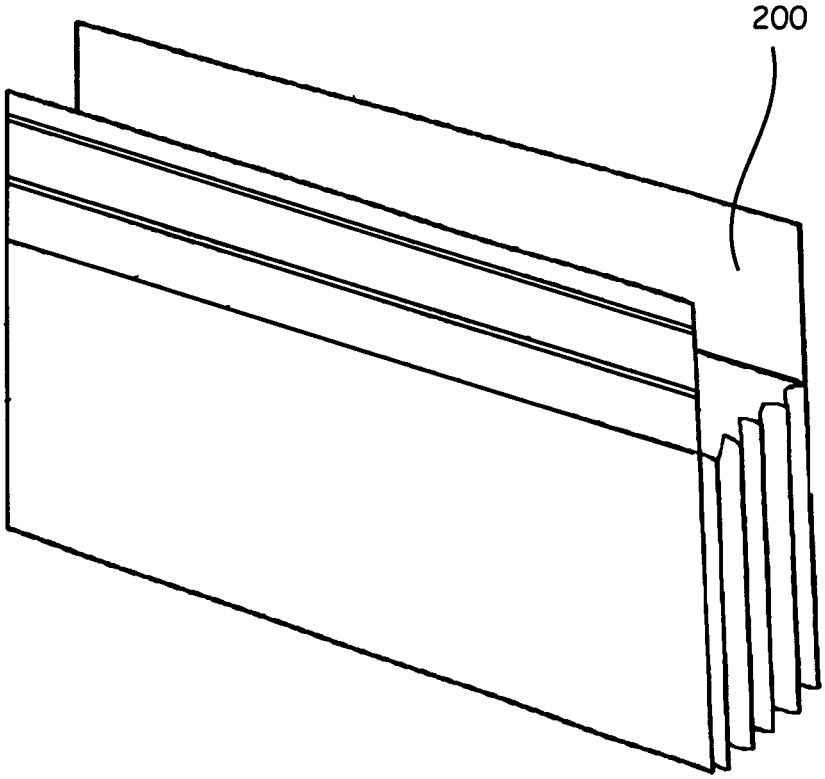
FIG. 2 (PRIOR ART)
FIG. 2 is a perspective view of pocket folder showing dividers and papers.
Figure 3:
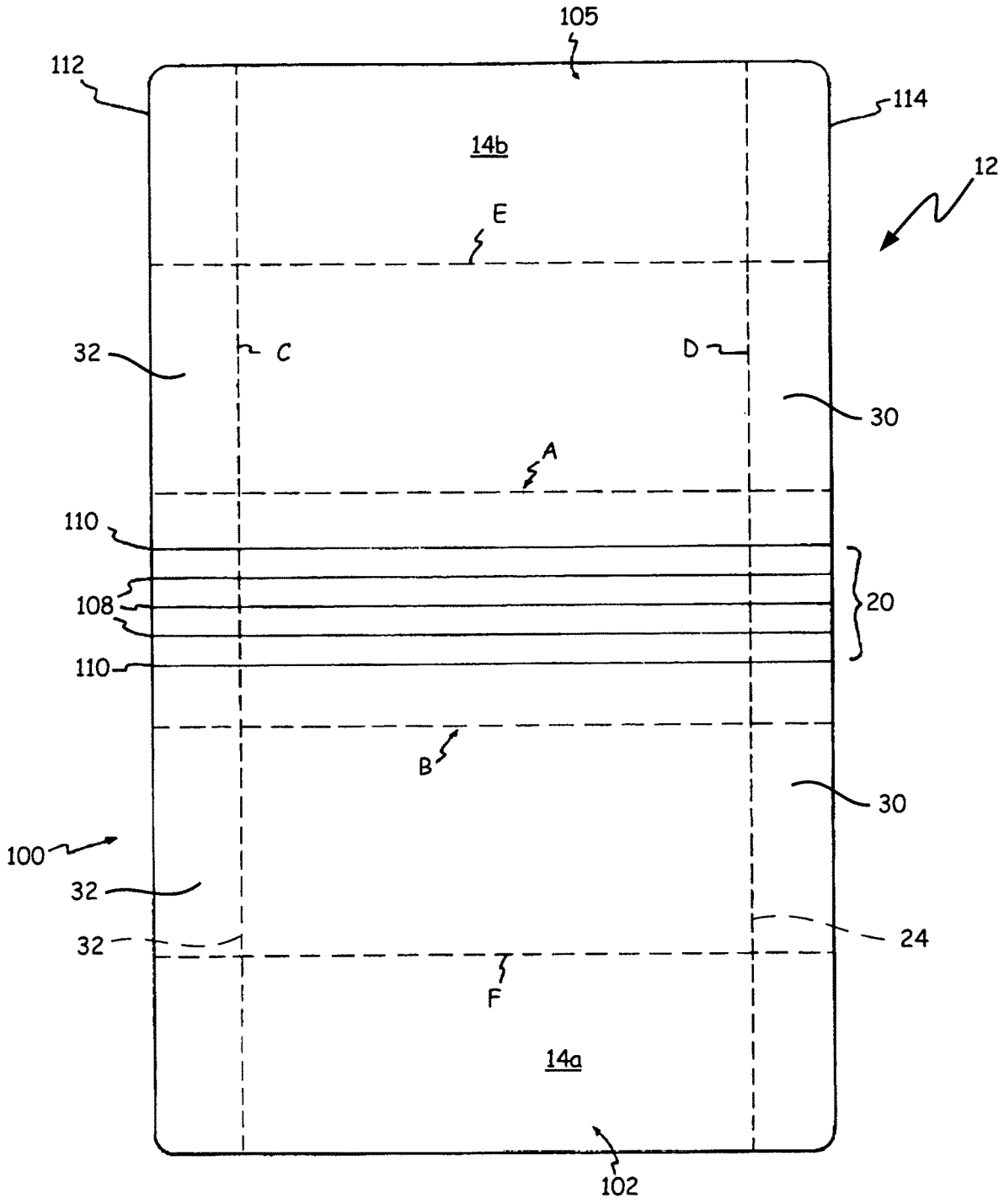
FIG. 3 is a top plan view of the sidewalls and bottom of the pocket folder.

The insert unit 200 is shown in FIGS. 5-9 and partially visible in FIG. 2. It can be constructed in multiple ways, but the preferred construction is that it is a unitary element which is emplaced in the pocket and can be removed as desired.

Figure 5:
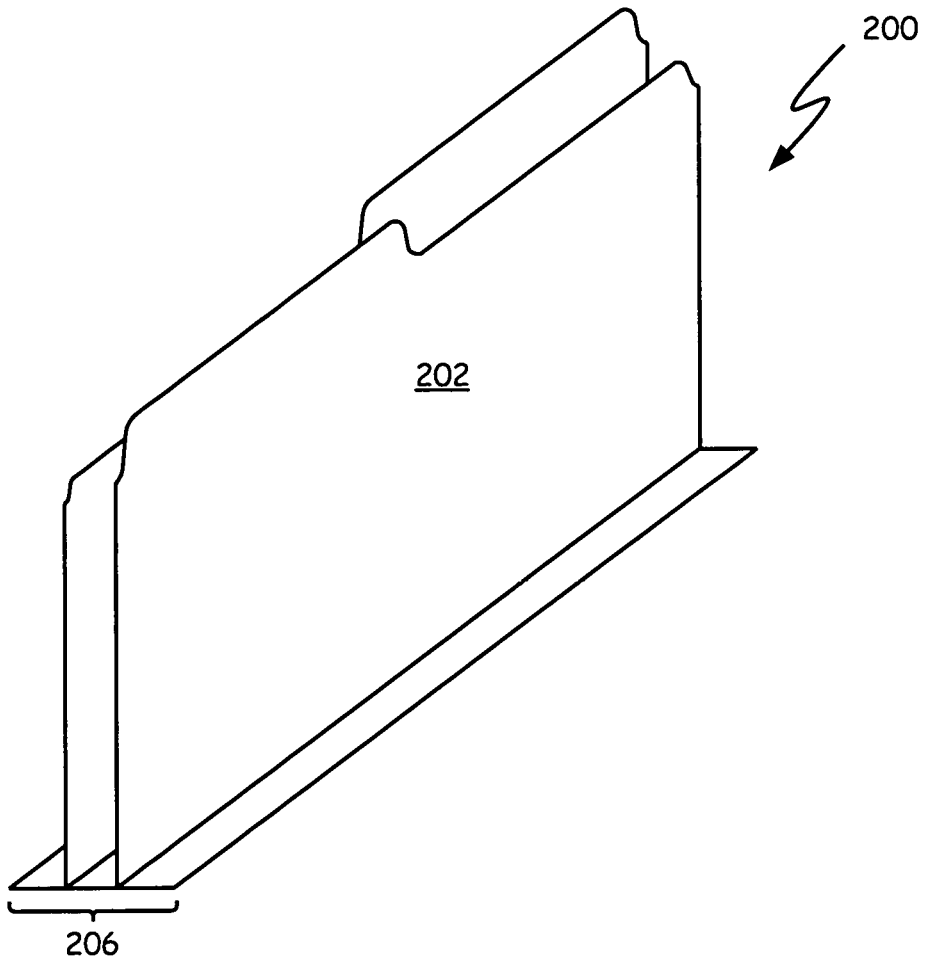
FIG. 5 is a perspective view of an insert unit for a pocket folder.

In FIG. 5, unit 200 is shown to have two spaced apart vertical walls 202/204 which are joined at their bottom by connector portion 206. The connector is formed differently in different embodiments.

Figure 6:
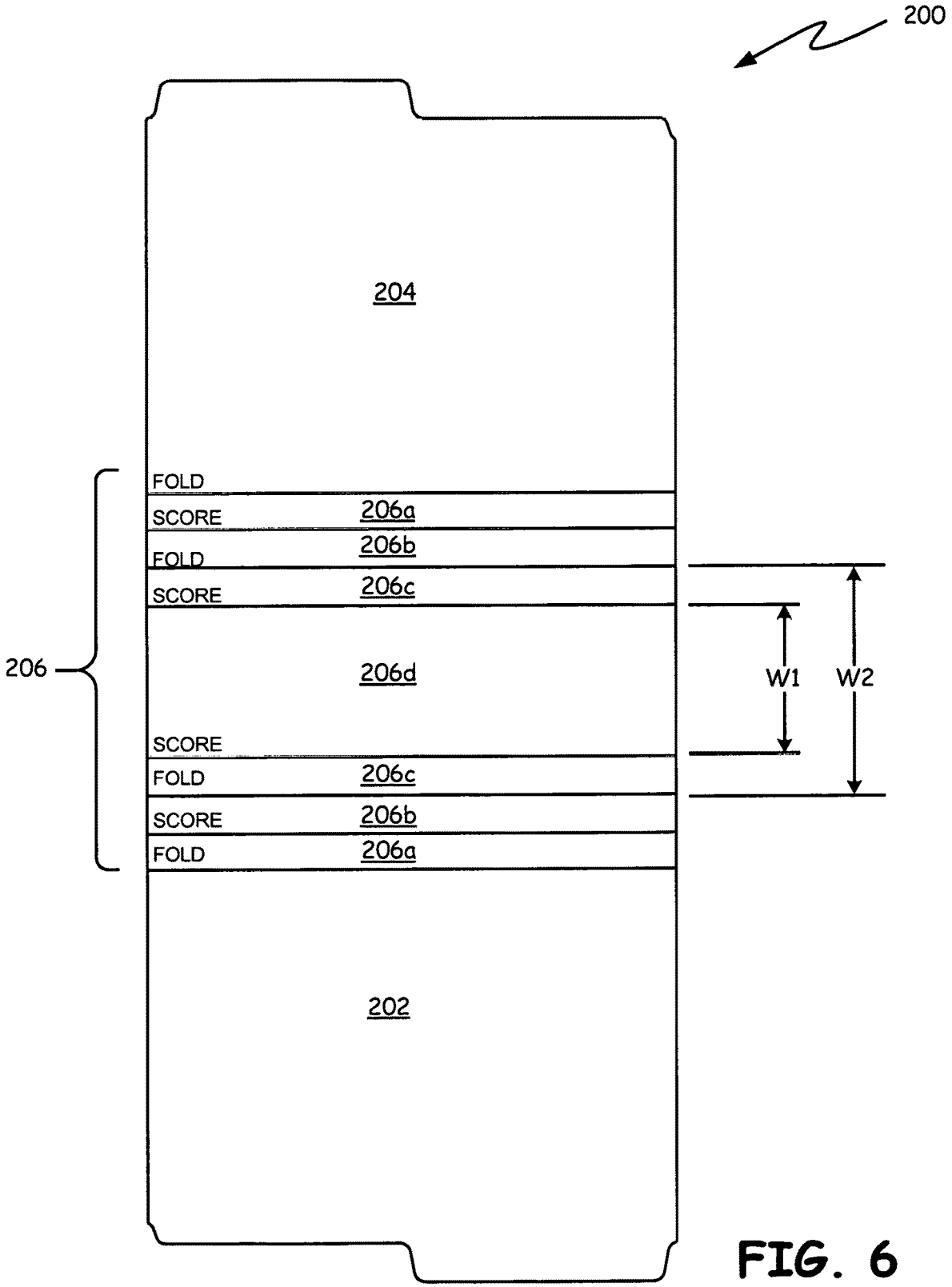
FIG. 6 is a front plan view of FIG. 5.

The embodiment shown in FIG. 6 is formed of a single unitary structure but may have extra optional score and fold lines which allow for user adjustment of the gap between panels. Insert unit 200 is formed from a single piece of stock, preferably a cardboard or semi rigid material typical of file folder stock. A series of fold line scores are formed in the connector portion 206. Between the scores, are regions 206*a*, 206*b*, 206*c* on either side of the floor portion 206*d*. The scores therefore are symmetrical about the floor 206*d*.

In this embodiment, the stock is folded between 206*b* and 206*c* with portions 206*b*/206*c* glued/affixed to portion 206*d*. This occurs on both sides of 206*c*. The result is that two flanges/feet are created by the span of 206*b*/206*c* affixed to 206*d*. When inserted into the pocket, these feet provide stability and inhibit movement of the unit within the pocket especially when the pocket is filled with papers which thereby press the feet into the bottom of the pocket. It is also possible for the feet to be glued to the pocket or held in by a removable adhesive system such as Velcro® or releasable glue.

Notice that the both portions 206*a* and 206*b* overlie 206*c*/206*d* in this embodiment. This is so that the score between the portions 206*a*/206*b* can be folded upwardly on both sides so that the span of the foot is reduced by the width of 206*a* according to user needs. This feature, of extra score and fold lines can also be incorporated in all embodiments to provide easy user adjustment of the panel spacing, at least with respect to the panels which face the sidewalls of the pocket folder. If the desired width of the pocket is W1 then the portions 206*b*/206*c* are folded up. If the desired width of the pocket is W2, then portions 206*a*/206*b* are allowed to remain flat or orthogonal to panels 202/204. Thus, in this embodiment, the width of the foot is adjustable. It is within the scope of this invention to provide additional score lines parallel with those shown to provide additional foot width adjustment.

Likewise, in an alternate embodiment, portions 206*a* (or 206*b*) may be eliminated if no adjustment is desired.

Figure 7:
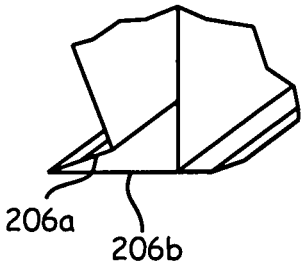
FIG. 7 is a close up fragmentary view of a portion of FIG. 5.
Figure 8:
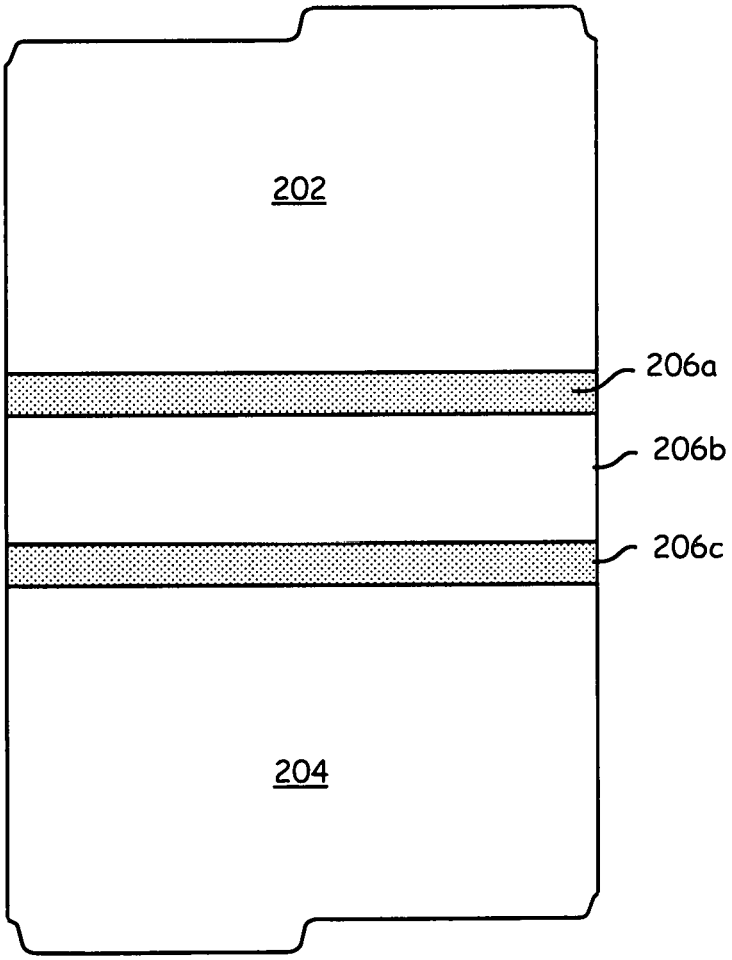
FIG. 8 is a top plan view of a second embodiment of one portion of the insert unit.

FIGS. 7 and 8 illustrate a simplified structure with fewer scores and folds. Panels 202/204 are scored and folded to create a region 206*a* which is scored and folded onto floor section 206, which can be of varied width according to need. Region 206*a* and 206*b* are bonded/glued to form the structure of FIG. 5.

FIGS. 9-12A illustrate alternate embodiments which have more than 2 divider elements. Three elements are shown, but additional elements are possible by replication of structures shown and described.

Figure 9:
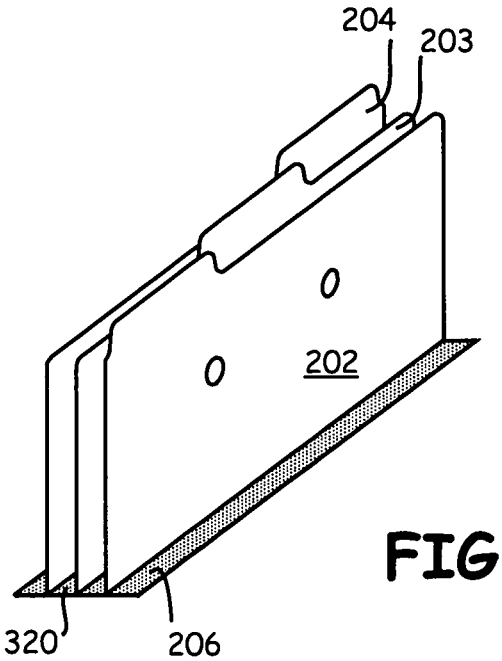
FIG. 9 is a perspective view of an embodiment with 3 element divider with a board base.
Figure 10:
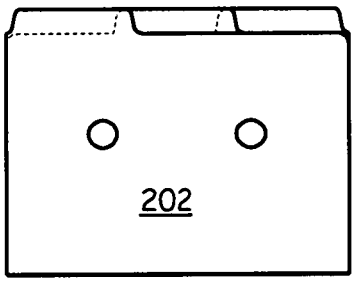
FIG. 10 is a side view of FIG. 9.
Figure 11:
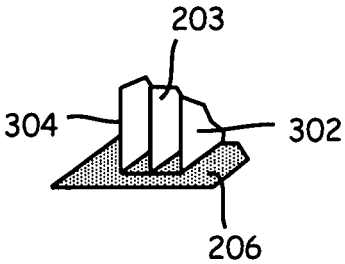
FIG. 11 is a close up fragmentary view of a portion of FIG. 9.
Figure 12:
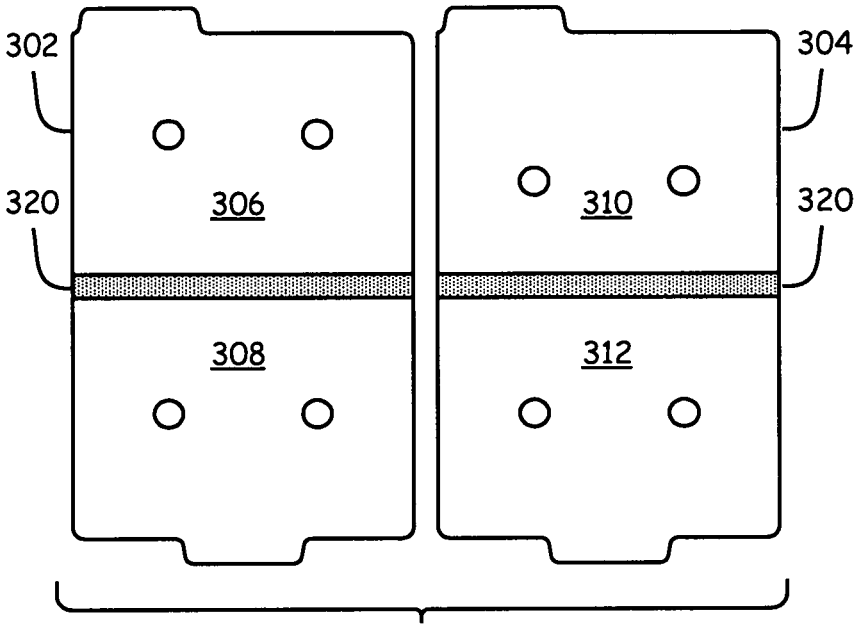
FIG. 12 is a top plan view of one portion of a 3 element insert unit.
Figure 12A:
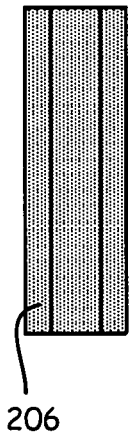
FIG. 12A is a top plan view of a base plate before installation in FIG. 9.
Figure 13:
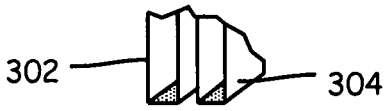
FIG. 13 is close up fragmentary exploded view of 2 portions separated before back to back bonding.

FIG. 9 illustrates a divider with a base 206 with three divider panels 202, 203 and 204. In this embodiment panel 203 is actually a double walled panel which results from scoring a pair of folder units 302/304 (FIG. 12) having faces 304\6/308/310/312 and bonding common abutting faces 308/310 or 306/312 as shown in FIG. 13 before bonding, and in FIG. 11 after bonding. In this embodiment, the middle divider panel with double thickness. It will be appreciated that any number of additional folder units 302 can be added to increase the number of dividers.

To form the base for this embodiment is a separate element 206 which is then bonded to the floor sections 320 (typically horizontal portions) of the folder units.

FIGS. 14-19 illustrate a further embodiment of a divider with three panels as in the previous embodiment but where there are no double walled portions. In this embodiment, each divider has a upright portion 402, 404, 406, a scored and folded line 410 and a region 412 folded generally 90 degrees of the upright portion as shown if FIG. 18. Tabs are 414 are shown in their respective $1^{st}$, $2^{nd}$ and $3^{rd}$ regions as known in the art for tabbed dividers. More, less or no tabs can be provided.

Figure 14:
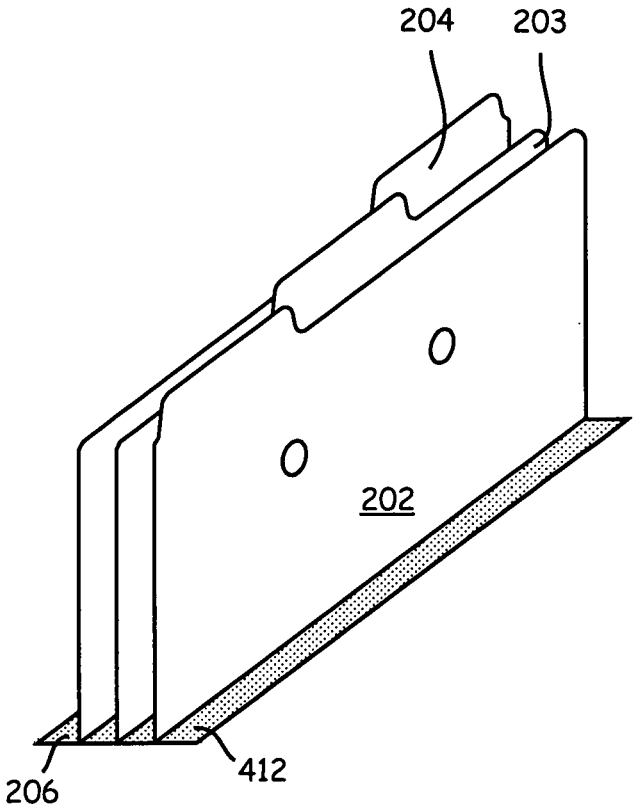
FIG. 14 is a perspective view of a further embodiment of a three element divider unit.
Figure 15:
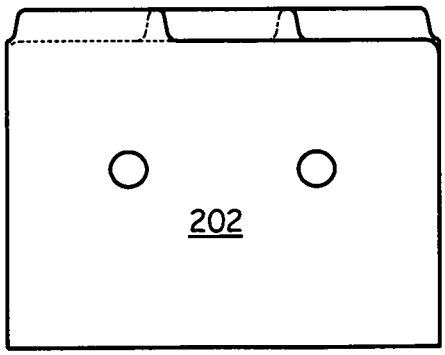
FIG. 15 is a side plan view of FIG. 14.
Figure 16:
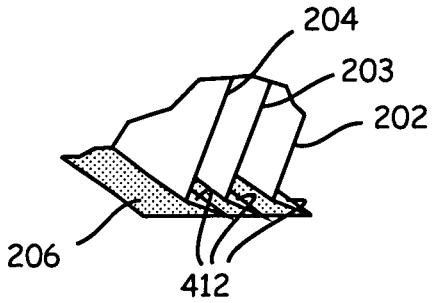
FIG. 16 is a close up fragmentary perspective view of the embodiment in FIG. 14 before bonding along fold lines to illustrate overlapping layers.
Figure 17:
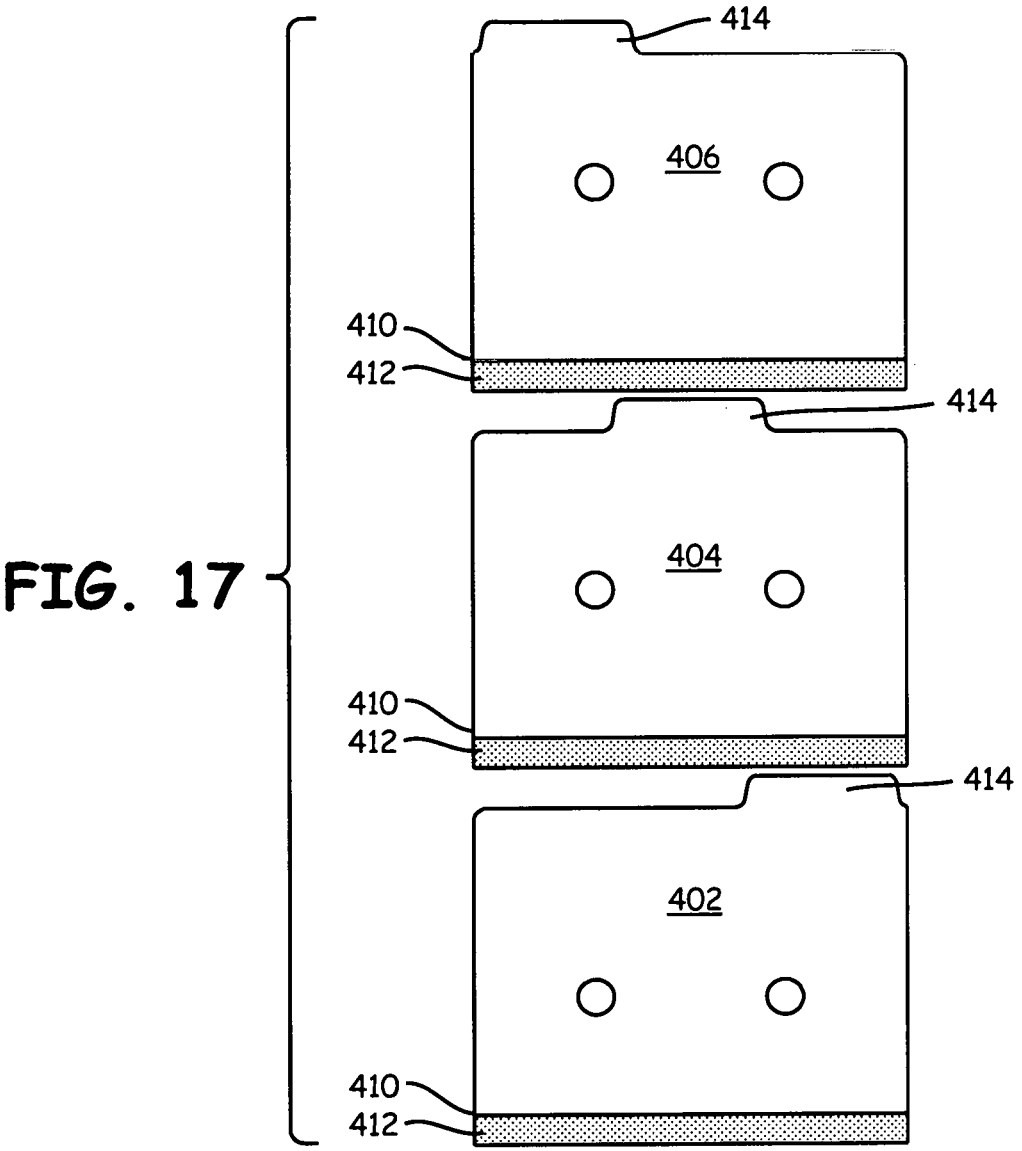
FIG. 17 is a side plan view of FIG. 14.
Figure 18:
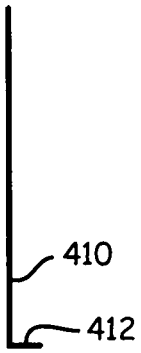
FIG. 18 is an end plan view of FIG. 17.
Figure 19:
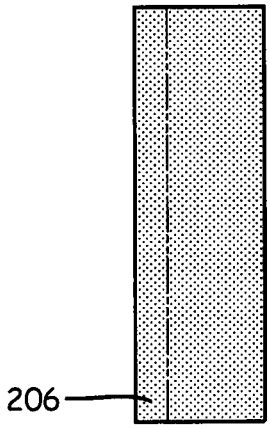
FIG. 19 is a top plan view of a base plate before installation in FIG. 14.

FIG. 16 illustrates how the panels 402 404 406 are applied to the base 206 and bonded thereto. The final assembly is shown in FIG. 14.

FIGS. 20-26 illustrate a further embodiment where there is no separate bottom element but it is integral to parts of one of the divider units.

Figure 23:
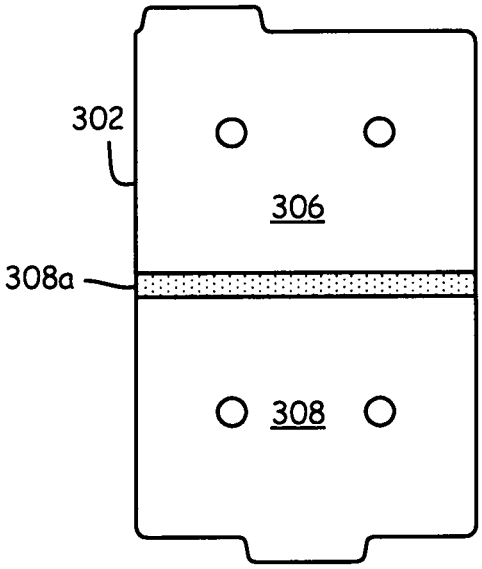
FIG. 23 is a plan view of an element for first and second dividers in a three divider system, unfolded.
Figure 24:
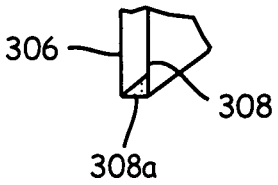
FIG. 24 is a close up fragmentary view of an element in a folded state.
Figure 25:
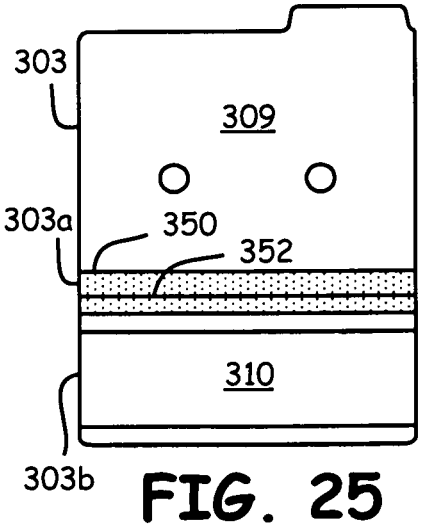
FIG. 25 is a plan view of a third element which works with the element in FIG. 23.
Figure 26:
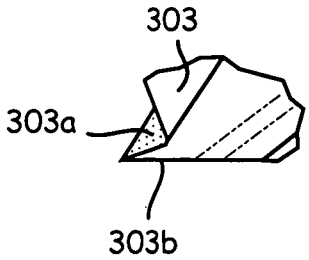
FIG. 26 is a close up fragmentary view of a portion of FIG. 20 before bonding.

FIGS. 23-24 illustrate the construction of this 2 part embodiment. Folder section 302 and 303 having panels 306, 308, 309 and 310 are scored and folded along score lines shown. Section 302 forms two divider panels 306 and 308 with a bottom 308*a* which will ultimately be bonded to portion 310 of divider 303. Folder section 303 includes a divider panel 309 and also forms the base 303*b* (corresponding to base 206 in other embodiments).

Figure 20:
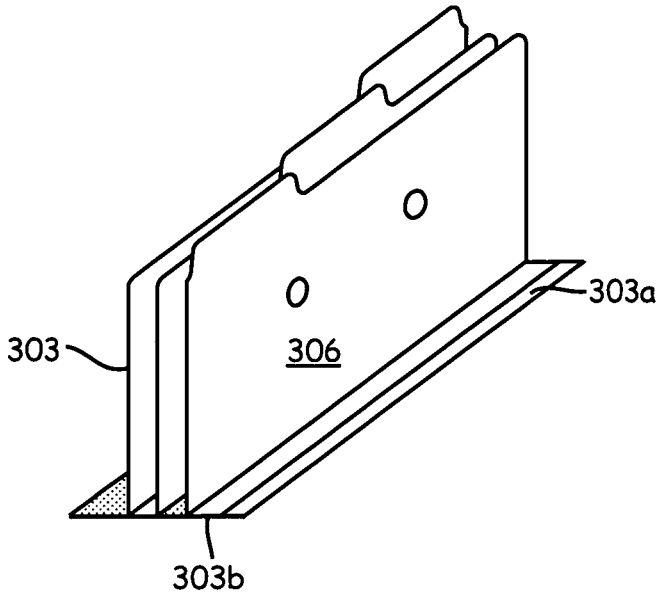
FIG. 20 is a perspective view of a 3 element divider without a separate base board.
Figure 20A:
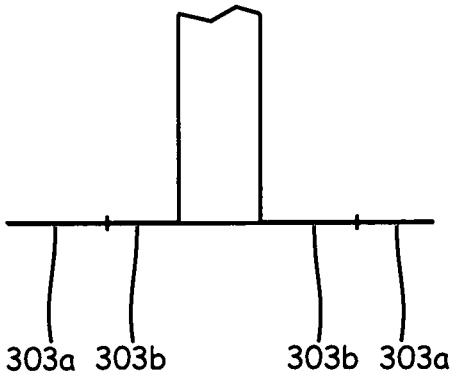
FIGS. 20*a*/20*b* illustrate an end view of a divider to create a gap with the outer walls first in the unfolded position (FIG. 20*a*) and then the folded position (FIG. 20*b*).
Figure 20B:
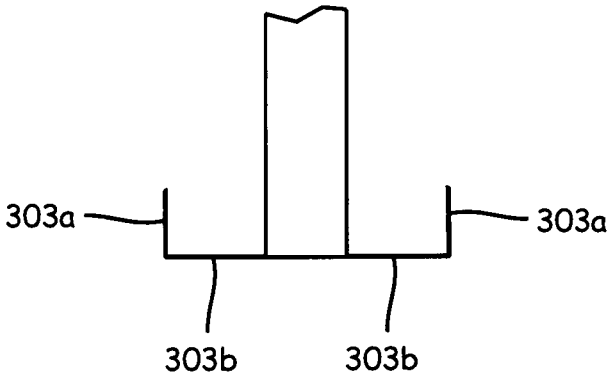
Figure 21:
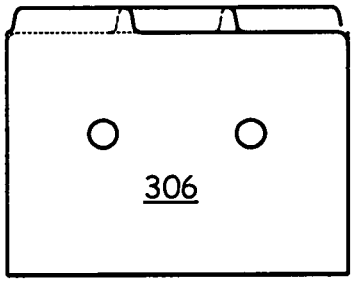
FIG. 21 is a side view of FIG. 20.
Figure 22:
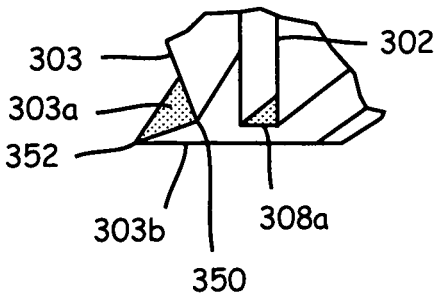
FIG. 22 is a close up fragmentary view of part of FIG. 20 before bonding to a base portion.

The assembly is shown if FIGS. 20 and 22. Section 303 is folded twice as score lines 350 and then again at 352 creating a narrow strip 302*a* corresponding to the width between divider panels 308 and 309. As seen in FIG. 22 the first fold 303*a* is folded and then bonded to base 303*b* to establish the first divider panel 303 and simultaneously the base 303*b* which receives the second panel unit 302 thereon and spaced from panel 309 to create a gap between plane sections. FIGS. 20*a*-20*b* illustrate this gap more clearly in folded (FIG. 20*b*) and unfolded (FIG. 20*a*) positions.

Figure 27:
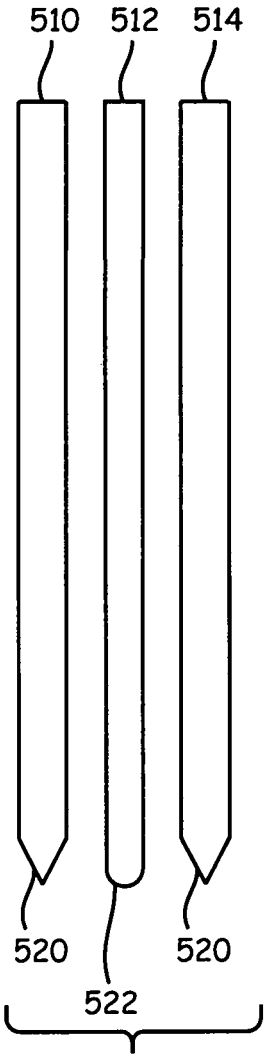
FIG. 27 is an end schematic view of three scoring tools.
Figure 28:
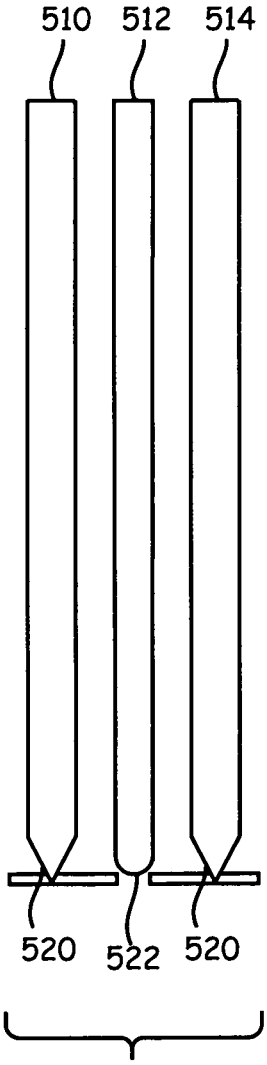
FIG. 28 is view like FIG. 27 applied to a sheet to be scored.
Figure 29:
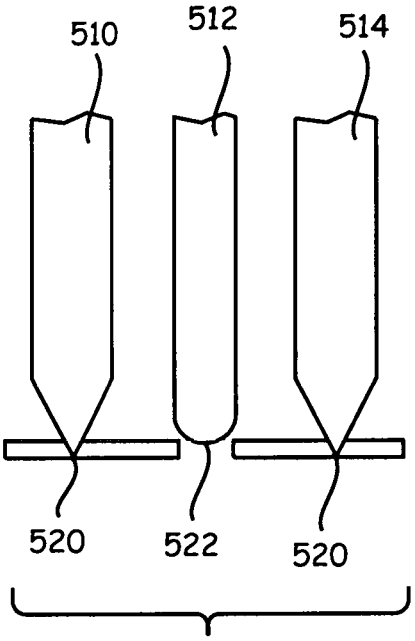
FIG. 29 is a close up fragmentary view of a portion of FIG. 28.

The scoring of material is illustrated in FIGS. 27-29. In the preferred embodiment, longitudinal scoring and folding is accomplished by tools 510, 512 and 514 shown in their end view. From above, they would appear has longitudinal bars with the tips as shown in the figures. Where a score is desired, the point tip 520 is preferred with a preferred tip angle of approximately 52 degrees. Where a rounded corner is desired, a score bar 512 with a rounded tip 522 is employed. The preferred radius of the rounded tip is approximately 0.042 inch (1.06 mm). All scores on all material are preferably accomplished at the same time by adjusting the spacing between score bars. To make scores and folds in a single unitary sheet in one stroke, the fold scoring/folding tool has sharp pointed tips located above fold lines and rounded tips above locations needed only score lines.

The method of manufacturer is to cut a single unitary blank and score an assemble the blank in accordance with the structure shown and bond elements also as shown. Unitary means that the material is a continuous web, not joined from separate pieces. The preferred cut pattern is as follows: a back panel with first and second sides having bottom edges and separated by a central fold line, the first side including a foldable extension panel which extends beyond the bottom edge. The extension forms the front panel of a foldable pocket and has lateral flaps.

The above description and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A method of forming a unitary web material into a divider system for insertion into a pocket folder, comprising the steps of:

a. cutting a blank of web material defining right and left edges and a center dividing line therebetween thereby defining left and right divider panels;

b. forming first fold lines in said web material spaced from and parallel with said center dividing line on both left and right divider panels;

c. forming second fold lines in said web material spaced from and parallel with said second fold line, on both left and right divider panels and thereby defining a portion between said first and second fold line and defining a foot region between first fold lines on right and left panels;

d. folding said web material on said first and second fold lines to fold said portion onto foot region and adhering said portion to said region on both left and right panels;

e. folding said second fold line to permit said left and right panels to be generally oriented orthogonally to said foot portion.

2. A method of forming a unitary web material into a divider system for insertion into a pocket folder, comprising the steps of:

a. cutting a blank of web material into a unitary sheet, having right and left edges and a center dividing line therebetween thereby defining left and right divider panels and a central foot panel;

b. upwardly folding said divider panels vertically with respect to the foot panel, thereby defining first fold lines at the intersection between the divider and foot panel;

c. inwardly folding said foot panel along a second fold line spaced from but parallel to the first fold line to create an overlapping portion between said first and second fold lines and adhering said overlapping panel to said foot panel thereby creating a double web portion;

d. upwardly folding said on both left and right divider panels at said second fold line, thereby defining a pair of upright divider panels with a spaced therebetween, all made from a unitary web.

3. The method of claim 2 wherein said step of adhering includes gluing.

4. The method of claim 3 wherein folding includes first scoring and then folding.

5. The method of claim 4, wherein scoring including scoring a center fold line and a scoring a line on either side of the central fold line.

6. The method of claim 5 wherein the scores on either side of the central fold line score are sharper than the central fold line score.

* * * * *